United States Patent [19]

Melconian

[11] Patent Number: 5,025,622

[45] Date of Patent: Jun. 25, 1991

[54] ANNULAR VORTEX COMBUSTOR

[75] Inventor: Jerry O. Melconian, Reading, Mass.

[73] Assignee: SOL-3- Resources, Inc., Reading, Mass.

[21] Appl. No.: 550,800

[22] Filed: Jul. 10, 1990

Related U.S. Application Data

[63] Continuation of Ser. No. 236,748, Aug. 26, 1988, abandoned.

[51] Int. Cl.[5] ..... F02C 3/14

[52] U.S. Cl. ..... 60/39.464; 60/732; 60/748; 60/755

[58] Field of Search ..... 60/755, 756, 759, 753, 60/732, 748, 39.36, 39.464, 39.37, 733, 750; 431/352

[56] References Cited

U.S. PATENT DOCUMENTS

| | | | |
|---|---|---|---|
| 1,591,679 | 7/1926 | Hawley | 60/39.464 |
| 2,638,745 | 5/1953 | Nathan | 60/755 |
| 2,718,757 | 9/1955 | Bloomer et al. | 60/755 |
| 2,736,168 | 2/1956 | Hanley | 60/756 |
| 4,539,918 | 9/1985 | Beer etal. | 60/39.464 |
| 4,695,247 | 9/1987 | Enzaki et al. | 60/755 |
| 4,702,073 | 10/1987 | Melconian | 60/755 |

OTHER PUBLICATIONS

Carlstrom, L. A. et al, "Improved Emissions Performance in Today's Combustion System", AEG1 SOA 7805, Jun. 14–17, 1978, p. 17.

*Primary Examiner*—Louis J. Casaregola
*Assistant Examiner*—Timothy S. Thorpe
*Attorney, Agent, or Firm*—Joseph S. Iandiorio; Brian M. Dingman

[57] ABSTRACT

A circumferentially stirred variable residence time vortex combustor including a primary combustion chamber for containing an annular combustion vortex and a first plurality of louvres peripherally disposed about the primary combuston chamber and longitudinally distributed along its primary axis, the louvres inclined to impel air circumferentially about the primary axis within the primary combustion chamber, to cool its interior surfaces, to impel air inwardly to assist in driving the annular combustion vortex in a helical path, and to feed combustion in the primary combustion chamber. The vortex combustor further includes a second annular combustion chamber and a narrow annular waist region interconnecting the output of the primary combustion chamber with the second annular combustion chamber for passing only lower density particles and trapping higher density particles for substantial combustion in the annular combustion vortex of the primary annular combustion chamber.

21 Claims, 5 Drawing Sheets

ANNULAR VORTEX COMBUSTOR

This is a continuation of application Ser. No. 07/236,748, filed Aug. 26, 1988, now abandoned.

FIELD OF INVENTION

This invention relates to a multichamber (multizone) annular vortex combustor, and more particularly to such a combustor which provides variable resistance time to achieve complete combustion of fuel particles.

BACKGROUND OF INVENTION

Currently there are two types of annular combustor turbines that are configured to enhance combustion by inducing one or more vortices of fuel particles entrained in air. One type of annular combustor turbine is a can annular combustor which consists of separate combustor chambers interconnected by conduit (interconnectors). Pressurized air from a compressor is directed into the chambers by creating a pressure drop within the chambers and by stators which remove the helical swirl of pressurized air exiting the compressor. This air is mixed with fuel particles and ignited by a single ignitor. Flame from the combustion of the gas and air mixture is propagated to the chambers via the conduits. A disadvantage of the can annular combustor is that the metal walls of the different chambers require a considerable amount of cooling.

The other type of annular turbine is a full annular combustor which aerodynamically maintains individual combustor chambers. The walls between the individual chambers are eliminated to reduce the weight of the combustor and the amount of air necessary to cool them. Each combustor chamber is aerodynamically formed by a swirler which is associated with a fuel injector. Air used for combustion is introduced into the combustion chamber through holes which are aligned with each chamber to insure proper air/fuel mixture. Flame generated by a single igniter propagates to all the chambers.

This type of combustor, however, has the disadvantage of losing some of the control of the combustion flame in each chamber when the power of the turbine is varied. This power is typically controlled by varying the speed of the compressor. Loss of flame control results from changing the swirling speed of the pressurized air introduced into the annular combustor. Since the stators used to remove the swirling component of the pressurized air are commonly positioned to properly direct pressurized air at full power, they fail to totally eliminate swirling components at different compressor speeds. Also, since the position of the holes are fixed, swirling components of the pressurized air are introduced into the individual chambers causing the ratio of the air/fuel mixture in each chamber to change. Changing the speed of compressor also changes the pressure drop necessary for introducing air for combustion. If the pressure drop needed for air to reach the center of the combustor is significantly reduced, the temperature of the core of the combustor increases.

A problem common to both of these annular combustor turbines includes introducing fuel particles of variable size. Larger sized particles experience the same residence time in these combustors as do smaller particles; this time, however, is often insufficient to completely combust the larger fuel particles except within the peak power range of the combustor. Efficiency outside this peak power range is noticeably decreased.

Cooling problems also exist for both combustors when the pressures of the combustors are increased to improve efficiency. Since increases in pressure result in hotter flames, temperatures of 4000° F. or more could develop which would melt the walls of the chambers if they are not sufficiently cooled. Typically, the outer surfaces of the combustor is cooled with air circulating around the combustor before it is introduced into the combustor. For most combustors, cooling steps are provided which introduce air in a direction parallel to the interior surface of the combustor to induce a blanket of air which insulates the interior surface from the combustion gas. Often, however, this air is used for cooling and not combustion which causes a poor combustion exit temperature distribution. As a result, additional cooling is required for cooling the turbine.

SUMMARY OF INVENTION

It is therefore an object of this invention to provide an improved annular multichamber (multizone) vortex combustor which causes circumferential mixing of fuel and air and hence an improved combustor exit temperature distribution.

It is a further object of this invention to provide an improved annular multichamber vortex combustor which establishes a variable residence time for fuel particles.

It is a further object of this invention to provide an annular vortex combustor which traps higher density fuel particles to ensure fragmentation and combustion of the particles.

It is a further object of this invention to provide such an annular multichamber multizone vortex combustor which more fully utilizes combustion air to cool internal surfaces of the combustor.

It is a further object of this invention to provide such an annular multichamber vortex combustor which utilizes the swirling component of pressurized air from a compressor to drive a combustion vortex.

It is a further object of this invention to provide such an annular multichamber vortex combustor which enables tailoring of the vortex to adjust residence time for fuel particles of different densities and size.

It is a further object of this invention to provide such an annular multichamber vortex combustor which is compact and light in weight.

It is a further object of this invention to provide such an annular multichamber vortex combustor which reduces the number of fuel nozzles.

It is a further object of this invention to provide such an annular multichamber vortex combustor which reduces the number of vanes that directs combusted air to the blades of a turbine.

It is a further object of this invention to provide such an annular multichamber vortex combustor which eliminates compressor exit stators.

It is a further object of this invention to provide such an annular multichamber vortex combustor which reduces the pressure loss required to introduce pressurized air into the combustion chamber.

It is a further object of this invention to provide such an annular multichamber vortex combustor which provides uniformly high combustion efficiency throughout its power range.

It is a further object of this invention to provide such an annular multichamber vortex combustor which can eliminate ash and other by-products directly from the primary combustion chamber of the combustor.

It is a further object of this invention to provide such an annular multichamber vortex combustor which minimizes the formation of nitrogen oxides by Rich burn-Quick quench-Lean burn air distribution to the combustor.

This invention results from the realization that a truly effective multichamber vortex combustor can be achieved by distributing a plurality of louvres both peripherally about a primary annular combustion chamber and longitudinally along its primary axis to impel air about the chamber for cooling its interior surfaces and to direct air inwardly for tailoring and assisting in driving a combustion vortex in the primary annular combustion chamber and for feeding combustion, and by interconnecting the primary annular combustion chamber to a second annular combustion chamber with a narrowed waist region which, in cooperation with air impelled by the louvres, passes only lower density particles to the second annular combustion chamber and traps higher density particles in the combustion vortex for substantially complete combustion. It is a further realization that radially opposed air jets at the narrowed waist provides impinging air for quickly quenching the products exiting the primary combustion chamber to maintain a low gas temperature and minimize the formation of nitrogen oxides.

This invention features a variable residence time annular vortex combustor. The combustor includes a primary annular combustion chamber for containing an annular combustion vortex and a second annular combustion chamber. A plurality of louvres are peripherally disposed about the primary combustion chamber and longitudinally distributed along its primary axis. The louvres are inclined to impel air circumferentially about the primary axis within the primary combustion chamber to cool its interior surfaces, to impel air inwardly, to assist in driving the annular combustion vortex in a helical path, and to feed combustion in the primary combustion chamber. A narrow annular waist region interconnects the output of the primary combustion chamber with the secondary annular combustion chamber for passing only lower density particles and trapping higher density particles in the annular combustion vortex in the primary annular combustion chamber for substantial combustion.

In one construction, the secondary annular combustion chamber includes a second plurality of louvres inclined to drive air within the secondary annular combustion chamber in approximately the same helical path as established by the louvres in the primary annular combustion chamber. These louvres also cool the inner surfaces of the second annular combustion chamber and assist in cooling combustion gases. Louvres along the second annular combustion chamber may be inclined to tailor the helical path of the combustor exit gases to that acceptable to a turbine. Radially opposing air jets may also be included in the waist region to quench the combustion gases and minimize the formation of nitrogen oxides.

The primary annular combustion chamber may also include scrolling means in communication with the interior of the primary annular combustion chamber and disposed circumferentially about its exterior surfaces for removing ash and other by-products developed during combustion. The primary combustion chamber may further include means for introducing fuel circumferentially into the annular combustion vortex. An igniter for initially igniting the air/fuel mixture may also be included in the primary annular combustion chamber. The louvres peripherally disposed about the primary combustion chamber are inclined to circumferentially drive air within the primary combustion chamber for establishing a vortex generally centered about the primary axis of the primary combustion chamber. The louvres may be inclined to impel air approximately tangential to the surfaces of the walls of the primary combustion chamber.

The annular combustion chamber may include inner and outer cylindrical walls which define the plurality of louvres. In one construction, the cylindrical walls are formed by a plurality of plates successively arranged about the primary axis to establish a plurality of junctions. Each of the plates may include interlocking means for interconnecting that plate with adjacent plates. Defined at each junction is at least one slot for establishing at least one louvre. In an alternate construction, the plurality of plates have portions that overlap adjacent plates to establish a junction. Spacer means are disposed between the overlapping portions of the adjacent plates for securing the overlapping plates in a spaced relationship to define louvres therebetween. The plurality of plates may be made from ceramic.

In an alternate construction, a circumferentially stirred variable residence time vortex combustor includes a primary annular combustion chamber for containing an annular combustion vortex. A first plurality of louvres are peripherally disposed about the primary combustion chamber and longitudinally distributed along its primary axis. The louvres are inclined to impel air circumferentially about the primary axis within the primary combustion chamber to cool its interior surfaces, to impel air inwardly, to assist in driving the annular combustion vortex in the helical path, and to feed combustion in the primary combustion chamber. The vortex combustor further includes a second annular combustion chamber which consists of a second plurality of louvres for driving air within the second annular combustion chamber in approximately the same helical path established by the first plurality of louvres to cool the inner surfaces of the second annular combustion chamber and to assist in cooling combustion gases. A narrow annular waist region interconnects the output of the primary combustion chamber with the secondary annular combustion chamber for passing lower density particles and trapping higher density particles in the annular combustion vortex within the primary annular combustion chamber for substantial combustion. The narrow annular waist region includes radially opposing air jets for introducing impinging air to quench the combustion gases exiting the primary chamber and for minimizing the formation of nitrogen oxides.

DISCLOSURE OF PREFERRED EMBODIMENTS

Other objects, features and advantages will occur from the following description of preferred embodiments and the accompanying drawings, in which.

This invention may be accomplished by a multichamber annular vortex combustor which has a primary annular combustion chamber containing a number of louvres distributed both peripherally about the primary annular combustion chamber and longitudinally along its primary axis. The louvres impel axial and circumferential velocities of pressurized air from a compressor about the annular interior of the chamber to cool its interior surfaces and impel air inwardly to assist in driving a combustion vortex in a helical path about the major axis of the primary combustion chamber. A narrow annular waist region separates the primary annular combustion chamber from a secondary annular combustion chamber. The waist region permits only lower density fuel particles introduced into the primary chamber by fuel injectors to pass to the secondary combustion chamber while trapping higher density particles in the combustion vortex of the primary combustion chamber for fragmentation and substantial combustion of those particles. The waist region is provided with radically opposing air jets which penetrate into the combustor to quench the hot gaseous products from the primary chamber and control the maximum gas temperature, thus minimizing the formation of nitrogen oxides.

In one construction, the secondary annular combustor includes a second plurality of louvres to drive air about the secondary annular combustion chamber in approximately the same helical path established by the louvres in the primary annular combustion chamber, to cool the inner surfaces of the second annular combustion chamber, and to assist in cooling combustion gases. These louvres are also inclined to tailor the helical path of the combustor exit gases to that acceptable to a turbine.

The variable residence time vortex combustor in this construction is well-suited for combusting a mixture of fuel compounds such as coal, coal-oil, or coal-water mixtures. The primary annular combustion chamber may further include a scroller which is disposed circumferentially about its exterior surface and communicates with its interior to remove ash and other by-products developed during combustion.

Figure 1:
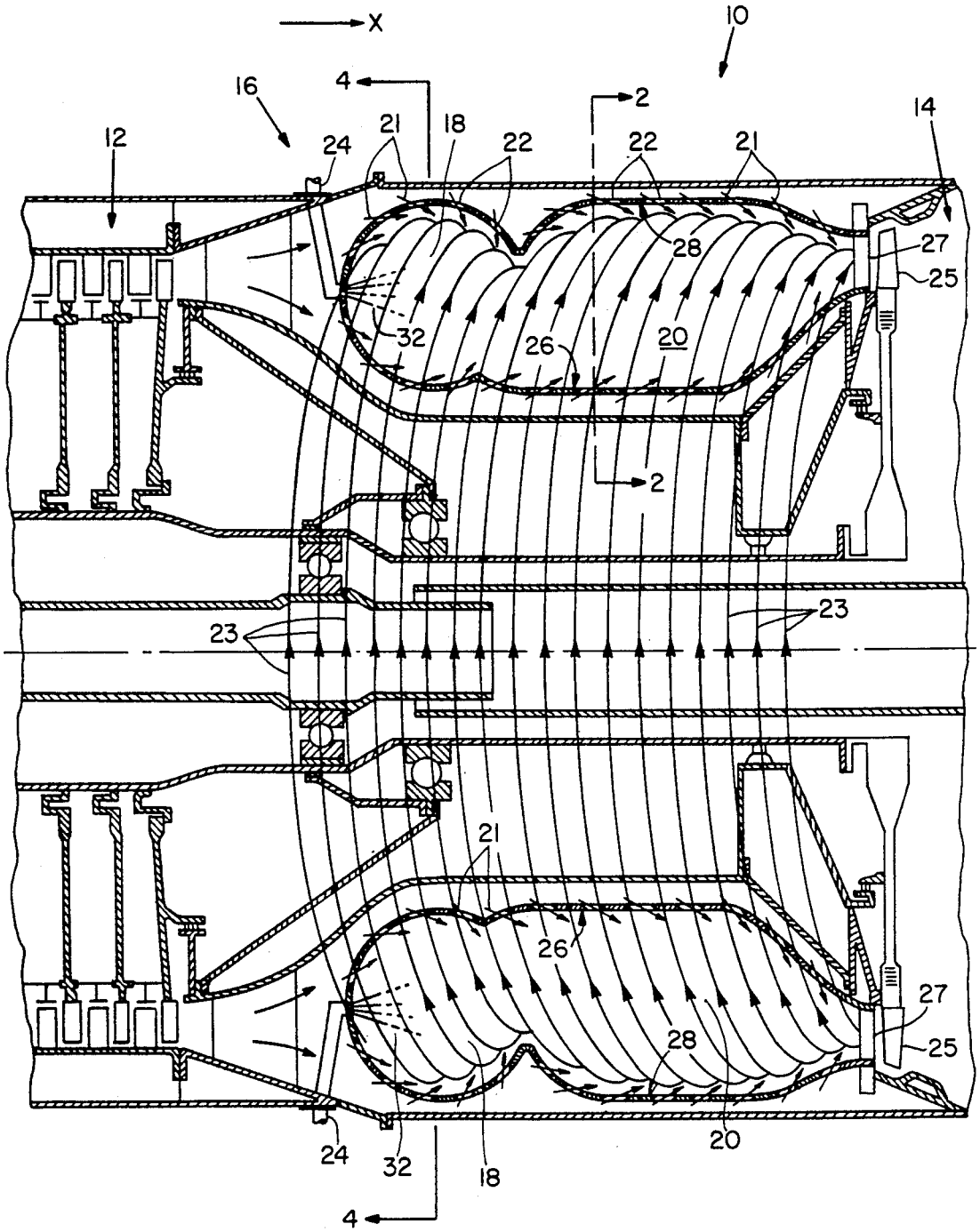
FIG. 1 is a schematic cross-sectional view of a turbine engine including a compressor, an annular vortex combustor according to this invention, and a turbine.

Variable residence time annular vortex combustor 10 is shown in FIG. 1 as a component between a compressor 12 and a turbine 14 of a gas turbine engine 16. Compressor 12 is a conventional compressor which compresses ambient air and immerses combustor 10 in pressurized air. Characteristically, air exiting compressor 12 has axial and circumferential velocities. Combustor 10 includes a primary annular combustion chamber 18 and a secondary annular combustion chamber 20. Louvres 22 are peripherally disposed circumferentially about the inner and outer walls 26, 28 of chambers 18 and 20 and longitudinally along the primary axis of combustor 10. Louvres 22 are fixed tangential slots which direct air, indicated by arrows 21, into primary and secondary chambers 18, 10 and helically about the primary axis of turbine engine 16 as indicated by arrows 23. Louvres 22 located at secondary combustor chamber 20 are inclined to direct the swirling air 23 so that it strikes blades 25 of turbine 14. Turning vanes 27 may be located between combustor 10 and turbine 14 to impart a helical trajectory to the combustor exit gases compatible with the blades 25 of turbine 14. Fuel 32 is circumferentially introduced into primary annular combustion chamber 18 by fuel injectors 24 and entrained in air by the helical motion of pressurized air 23.

Figure 2:
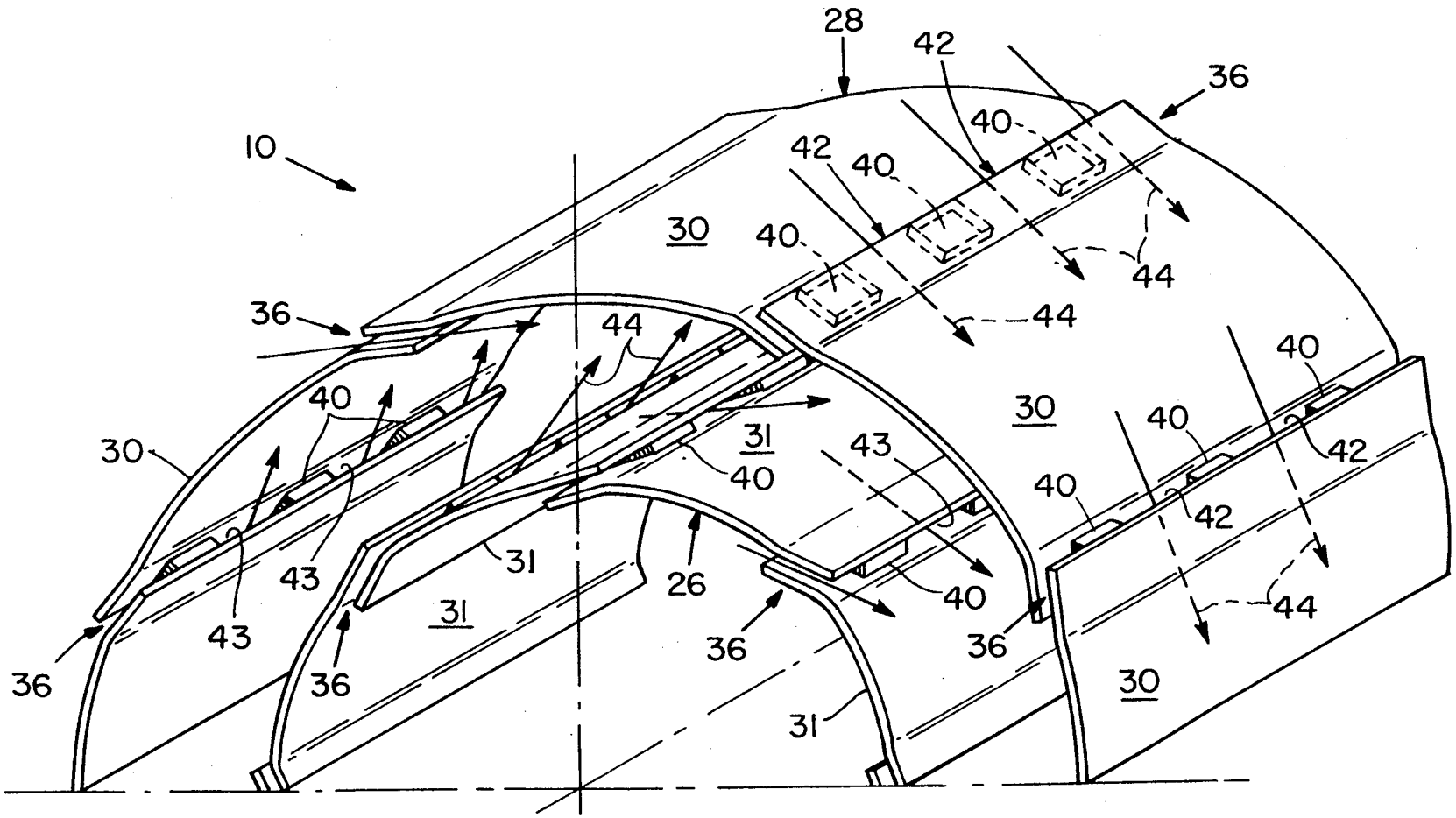
FIG. 2 is a three-dimensional, cross-sectional view taken along line 2—2 of FIG. 1 of a portion of the combustor illustrating its wall construction.

The construction of inner and outer walls 26 and 28 of combustor 10 are shown in greater detail in FIG. 2. Each wall consists of a series of plates 30 and 31 which are successively arranged about the primary axis to form inner and outer cylindrical walls 26, 28. Each series of plates 30 and 31 includes overlapping plate portions 36 which are spaced by spacers 40 to define slots 42 and 43, respectively. These slots 42, 43 operate as louvres for introducing air into combustor 10, as indicated by arrows 44. Slots 42 and 43 are situated so that air enters combustor 10 approximately tangent to the surfaces of walls 26 and 28. Louvres constructed in this manner are compatible with the path of the air flow supplied by compressor 12. The number of slots 42 and 43 as well as their exact angle of inclination may vary depending on the size, pressure, and temperature constraints of the combustor.

Figure 3:
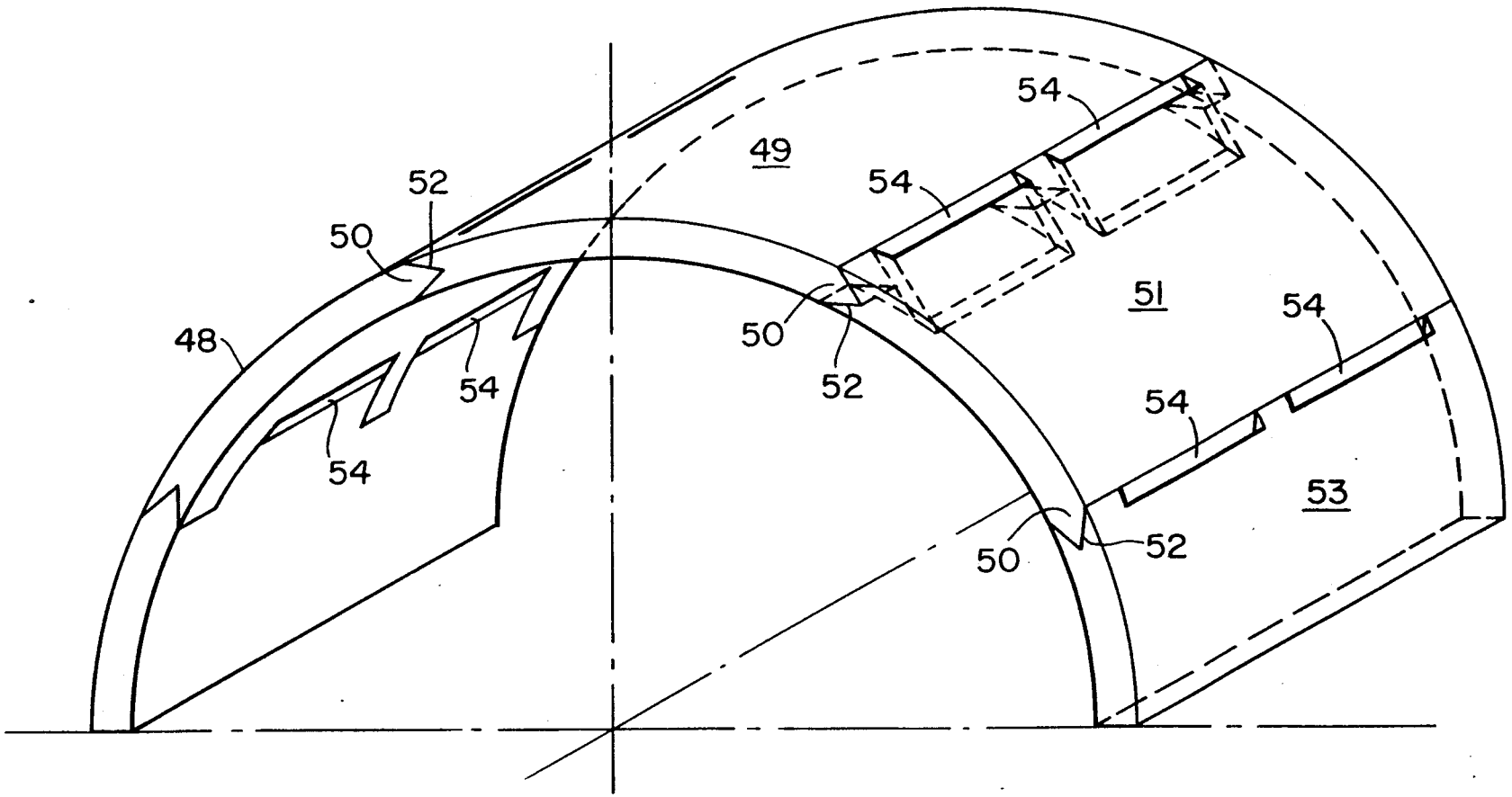
FIG. 3 is a three-dimensional cross-sectional view of an alternate wall construction for the combustor shown in FIG. 1.

In an alternate construction, walls 26 and 28 of combustor 10 are assembled from interlocking curvilinear ceramic plates 48, 49, 51, 53 as shown in FIG. 3. Each plate 48, 49, 51, 53 includes a tongue and groove portion 50, 52 which mate to a groove and tongue portion, 52, 50 of an adjacent plate, respectively. Tangential slots 54 are formed at the junction of two plates and are used for introducing air into combustor 10. In the preferred embodiment these slots 54 are formed along the groove portions 52, but may be formed along the tongue portions 50 or a combination of both. Forming slots at the junctions of two plates 48 improves the durability of the plates.

Figure 4:
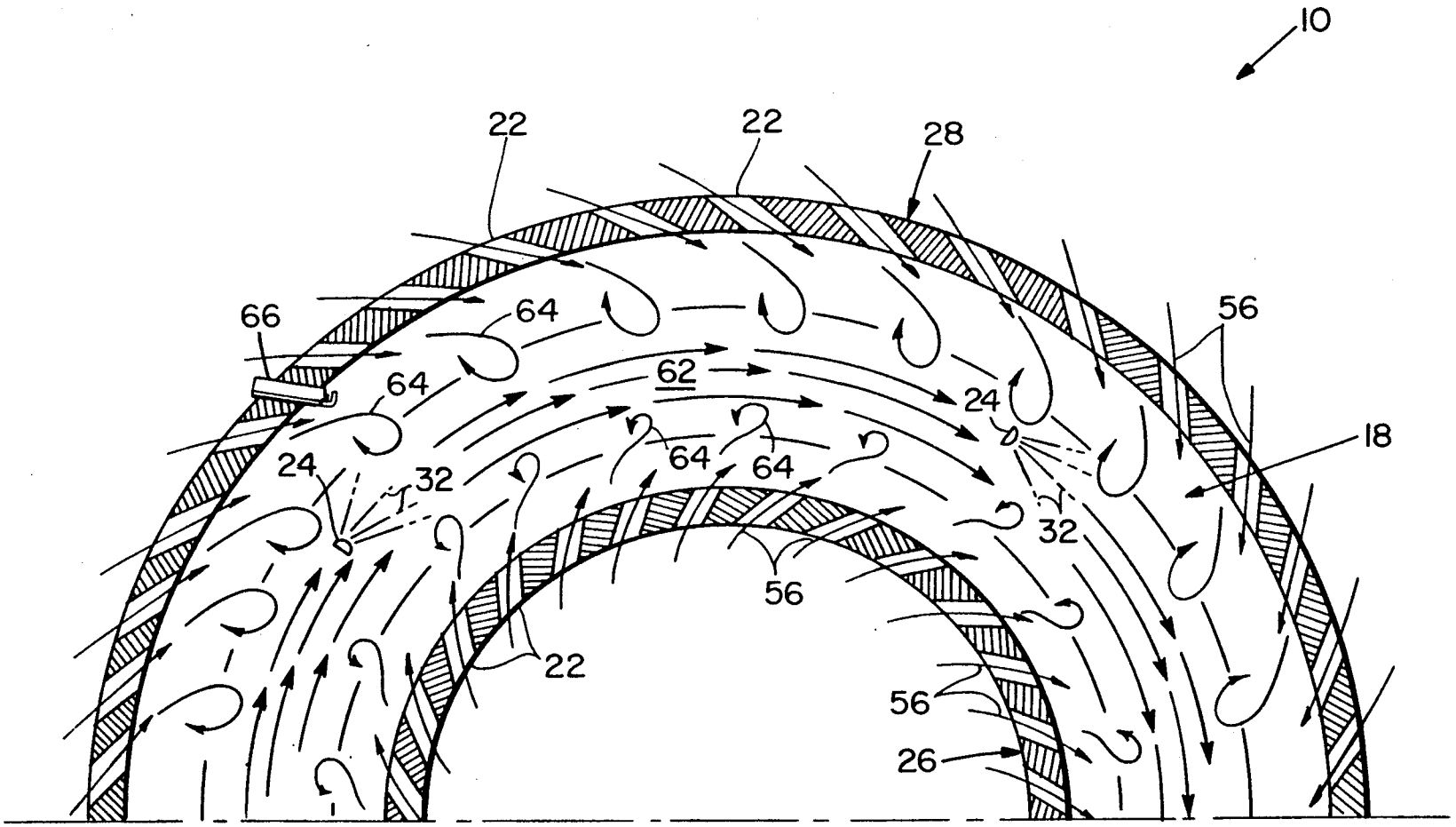
FIG. 4 is a cross-sectional view along line 4—4 of the annular vortex combustor FIG. 1 illustrating the transverse flow pattern in the primary chamber of the combustor.

Variable residence time combustors according to this invention enable adjustment of the residence time of fuel particles according to the density and size of those fuel particles within primary combustion chamber 18. The flow pattern of the fuel-air mixture in primary annular combustion chamber 18 is shown in greater detail in FIG. 4. Higher pressure air, indicated by arrows 56, passes over the exterior surfaces of inner and outer walls 26 and 28, respectively, and is drawn through louvres 22 to the hot gases of the combustion vortex 62, since it has a lower density. Since the pressurized air is introduced approximately tangential to the surfaces of walls 26 and 28, it also cools the inner surfaces of walls 26 and 28 before combining with the hot gases of vortex 62. When the higher pressure air comes into contact with the hot gases of vortex 62, combustion vortex 62 is compressed and eddy currents 64 are created which assist in aerodynamically vaporizing and mixing fuel 32 as it is introduced by fuel injector 24. The combustion vortex is initially created by igniting the fuel rich mixture using an ignitor 66.

Figure 5:
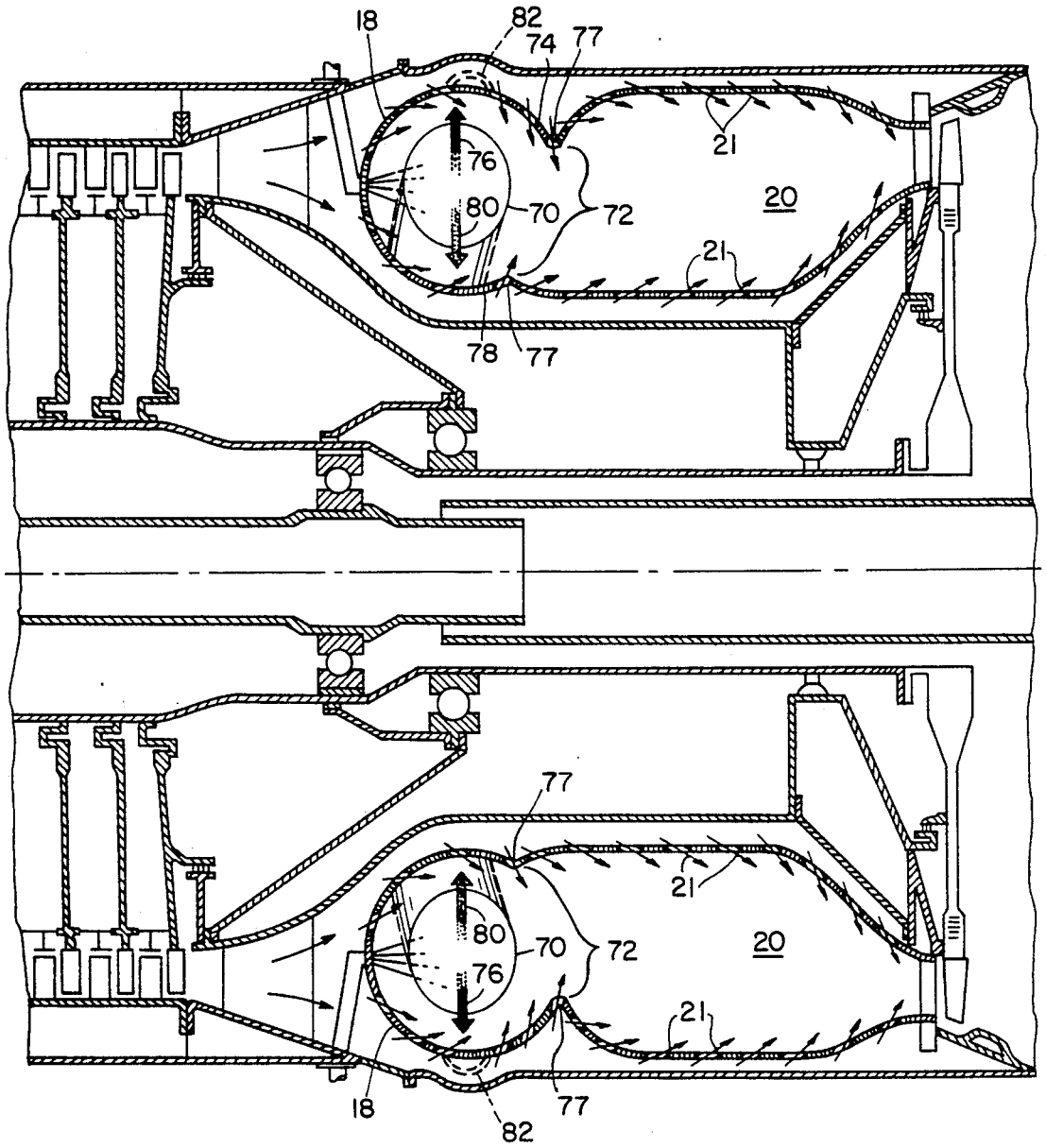
FIG. 5 is a schematic cross-sectional view of an annular vortex combustor of FIG. 1 illustrating the flow of fuel and gases and their variable residence time.

Swirling components of the pressurized air are directed by louvres 22 which radially and longitudinally locate the combustion vortex to create a torus 70 as shown in FIG. 5. Torus 70 is a toroidal configuration of combustion gases which includes trapped higher density particles. Centrifugal force drives denser particles to the outer portion of torus 70, as indicated by arrow 76. These particles are trapped for a substantial time to complete combustion in primary annular combustion chamber 18 by waist region 72 before passing to secondary annular combustion chamber 20. The air jets formed at the waist region along outer wall 74 are aligned with air jets formed at the waist region along inner wall 78 so that they are radially opposed to each other for quickly quenching the products exiting the primary combustion chamber to maintain a low gas temperature and to minimize the formation of nitrogen oxides. In chamber 20 the combustion of unburned gaseous products is completed.

As the trapped higher density particles are fragmented and combusted in primary annular combustion chamber 18, smaller, hotter, and therefore less dense particles travel inwardly in the direction indicated by arrow 80. The lightest, hottest particles escape past waist region 72 as combustion gases. Additional pressurized air entering through air jets 77 in the waist region penetrates the core of the combustion vortex to provide additional air for quenching and further combustion. Thus a temperature gradient is established through torus 70 with the highest temperature situated near the primary axis, and the lowest temperature situated near the surfaces of primary combustion chamber 18. With such a temperature gradient the combustion heat experienced by those surfaces is reduced.

Approximately 80 percent or more of combustion is accomplished in the primary combustion chamber 18. Incompletely combusted gases such as carbon monoxide and unburned hydrocarbons are burned in secondary combustion chamber 20. Louvres 22 of the secondary combustion chamber 20 compel pressurized air, indicated by arrows 21, tangentially in a rotational direction that is approximately equal to the helical path established by louvres 22 of the primary combustion chamber 18. This air flow cools the combustion gases and directs the combustor exit gases in a direction that is acceptable to turbine blades 25.

Variable residence time combustor 10 not only provides uniform high combustion efficiency throughout its power range but also accepts a variety of fuel mixtures. When coal, coal-oil, or coal-water slurries are combusted, it is desirable to provide primary combustion chamber 18 with scroller 82, indicated in phantom in FIG. 5. Ash and other high density by-products are carried by the centrifugal force radially outward from torus 70, to the opening of scroller 82, not shown. As combustion vortex rotates the most dense particles are spun through circumferential openings and travel through a scroller where they are exhausted through outlets. Unlike the placement of scrollers on conventional combustors, scroller 82 is radially based from the combustor vortex at the region of primary combustion. The by-products are thereby eliminated as soon as possible to minimize their interference with the combustion process.

Although specific features of the invention are shown in some drawings and not others, this is for convenience only as each feature may be combined with any or all of the other features in accordance with the invention.

Other embodiments will occur to those skilled in the art and are within the following claims.

What is claimed is:

1. A circumferentially stirred variable residence time vortex combustor comprising:

a toroidal shaped primary annular combustion chamber disposed around a primary axis in the X-direction including an inner primary wall and an outer primary wall for containing an annular combustion vortex, at least one of said inner primary and said outer primary walls defining a first plurality of louvres peripherally disposed about said primary combustion chamber and longitudinally distributed along its primary axis, said louvres inclined to impel air circumferentially about the primary axis within said primary combustion chamber to cool its interior surfaces, to impel air inwardly to assist in driving the annular combustion vortex in a helical path and to feed combustion in said primary combustion chamber;

a secondary annular combustion chamber including an inner secondary wall and an outer secondary wall; and a narrow annular waist region, interconnecting the output of said primary combustion chamber with said secondary annular combustion chamber and defined by said outer wall, for passing only lower density particles and trapping higher density particles in the annular combustion vortex in said primary annular combustion chamber for substantial combustion.

2. The vortex combustor of claim 1 in which said secondary annular combustor chamber includes a second plurality of louvres inclined to drive air within said secondary annular combustion chamber in approximately the same helical path established by said louvres in said primary annular combustion chamber, to cool the inner surfaces of said second annular combustion chamber, to complete the combustion process, and to assist in cooling combustion gases.

3. The vortex combustor of claim 2 in which said second plurality of louvres are inclined to tailor the helical path of the combustor exit gases to that acceptable to a turbine.

4. The vortex combustor of claim 1 further including a series of radially opposed air jets at said waist region to quench combustion gases, minimize formation of nitrogen oxides, and further feed combustion.

5. The vortex combustor of claim 1 in which said toroidal shaped primary annular combustion chamber further includes scrolling means, in communication with the interior of said primary annular combustion chamber and disposed circumferentially about its exterior surfaces most remote from said primary axis, for removing ash and other by-products developed during combustion.

6. The vortex combustor of claim 1 in which said primary combustion chamber further includes means for introducing fuel into the annular combustion vortex.

7. The vortex combustor of claim 6 in which said means for introducing fuel includes a fuel injector for injecting fuel circumferentially into the annular combustion vortex to form a fuel-air mixture.

8. The vortex combustor of claim 7 in which said primary annular combustion chamber further includes an ignitor for igniting the fuel-air mixture.

9. The vortex combustor of claim 1 in which said first plurality of louvres are inclined to circumferentially drive air within said primary combustion chamber for establishing a vortex generally centered about the primary axis of said primary combustion chamber.

10. The vortex combustor of claim 1 in which said first plurality of louvres are inclined to impel air approximately tangential to the surfaces of the walls of said primary combustion chamber.

11. The vortex combustor of claim 1 in which said inner and outer walls are coaxial.

12. The vortex combustor of claim 1 in which said primary and secondary chambers are formed by a plurality of plates successively arranged about the primary axis to establish a plurality of junctions.

13. The vortex combustor of claim 12 in which each of said plates including interlocking means for interconnecting that plate with adjacent plates.

14. The vortex combustor of claim 12 in which said plates define at each junction at least one slot for establishing at least one louvre at that junction.

15. The vortex combustor of claim 12 in which each of said plurality of plates has portions that overlap adjacent plates to establish a junction.

16. The vortex combustor of claim 15 further including spacer means disposed between overlapping portions of adjacent plates for securing the overlapping plates in a spaced relationship to define louvres therebetween.

17. The vortex combustor of claim 12 in which said plurality of plates are made from ceramic plates.

18. A circumferentially stirred variable residence time vortex combustor comprising:

a toroidal shaped primary annular combustion chamber disposed around a primary axis in the X-direction including an inner primary wall and an outer primary wall for containing an annular combustion vortex, at least one of said inner primary and said outer primary walls defining a first plurality of louvres peripherally disposed about said primary combustion chamber and longitudinally distributed along its primary axis, said louvres inclined to impel air circumferentially about the primary axis within said primary combustion chamber to cool its interior surfaces, to impel air inwardly to assist in driving the annular combustion vortex in a helical path, and to feed combustion in said primary combustion chamber;

a secondary annular combustion chamber including a second plurality of louvres for driving air within said secondary annular combustion chamber in approximately the same helical path established by said first plurality of louvres to cool the inner surfaces of said secondary annular combustion chamber and to assist in cooling combustion gases; and a narrow annular waist region, interconnecting the output of said primary combustion chamber with said secondary annular combustion chamber and defined by said outer wall for passing only lower density particles and trapping higher density particles in the annular combustion vortex in said primary annular combustion chamber for substantial combustion, and including a set of radially opposing air jets to quench the combusting gases and minimize the formation of nitrogen oxides.

19. A circumferentially stirred variable residence time vortex combustor comprising;

a toroidal shaped primary annular combustion chamber disposed around a primary axis in the X-direction for containing an annular combustion vortex, said primary combustion chamber established by a plurality of plates successively arranged about the primary axis of said combustor to form an inner and an outer wall for said primary chamber;

a plurality of louvres defined by said plates, said louvres inclined to impel air circumferentially about the primary axis within said primary combustion chamber to cool its interior surfaces, to impel air inwardly to assist in driving the annular combustion vortex in a helical path and to feed combustion in said primary combustion chamber;

a secondary annular combustion chamber; and a narrow annular waist region, interconnecting the output of said primary combustion chamber with said secondary annular combustion chamber and defined by said outer wall, for passing only lower density particles and trapping higher density particles in the annular combustion vortex in said primary annular combustion chamber for substantial combustion.

20. The circumferentially stirred variable residence time vortex combustor of claim 19 in which said second annular combustion chamber is established by a plurality of plates successively arranged to form an inner and outer wall.

21. The vortex combustor of claim 1 in which both of said inner primary wall and said outer primary wall define said first plurality of louvres.

* * * * *